United States Patent [19]

Fields

[11] 4,320,897

[45] Mar. 23, 1982

[54] BOWLING-BALL RETURN DEVICE

[76] Inventor: Wallice E. Fields, 405 Heritage, Eugene, Oreg. 97404

[21] Appl. No.: 193,938

[22] Filed: Oct. 6, 1980

Related U.S. Application Data

[63] Continuation of Ser. No. 17,369, Mar. 5, 1979, abandoned.

[51] Int. Cl.[3] ..... A63D 5/02

[52] U.S. Cl. ..... 273/49

[58] Field of Search ..... 273/49

[56] References Cited

U.S. PATENT DOCUMENTS 2,767,983 10/1956 Holloway et al. ..... 273/43 R 3,456,946 7/1969 Buck ..... 273/49

*Primary Examiner*—Anton O. Oechsle

*Attorney, Agent, or Firm*—Kolisch, Hartwell & Dickinson

[57] ABSTRACT

A device for enhancing bowling-ball capture in an automatic bowling-ball return apparatus of the type having a circular, rotatable conveyor and frictional guide members cooperative therewith to form a cradle in which the ball is conveyed. The conveyor and guide members define a ball capture station from which the ball enters the cradle. The device includes a gravity-biased arm pivotally mounted on the apparatus adjacent the capture station, and an elongate frictional member carried on the free end of this arm for urging the ball by gravity against the conveyor as it travels between its lowest point on the conveyor and the capture station.

1 Claim, 3 Drawing Figures

BOWLING-BALL RETURN DEVICE

CROSS-REFERENCE TO RELATED APPLICATION

This application is a continuation of my patent application for BOWLING-BALL RETURN DEVICE, Ser. No. 017,369 filed Mar. 5, 1979, abandoned.

BACKGROUND AND SUMMARY

The present invention relates to automatic bowling-ball return apparatus, and in particular, to a device designed for enhancing the operation thereof.

A conventional type of automatic pin setter used in a bowling alley includes a ball-return apparatus having a circular, rotatable conveyor at the end of the alley for receiving a ball and carrying the same to an elevated release position from which the ball is returned to the bowler. The ball-return apparatus generally includes a pair of guide members which extend from positions adjacent the bottom of the conveyor toward the top thereof, substantially concentric therewith. The guide members cooperate with the conveyor during ball capture and ball-return conveyance. Capture occurs as a ball is moved from a capture station into a cradle formed between the conveyor and the guide members.

Occasionally, in the operation of the above-described ball-return device, a ball fails to strike the guide members with sufficient impact to effect capture, whereupon the ball continues to spin in the capture station. When spinning occurs it is necessary for a bowling alley employee to intervene, manually forcing the ball into the ball-return cradle. This situation creates inefficiency in bowling alley operation, and may cause significant delay to a bowler.

Accordingly, it is a primary object of the present invention to provide a device, for use in a ball-return apparatus of the type just described, for enhancing ball capture.

Yet another object of the present invention is to provide such a device which is easily adjusted for optimal operation.

The device of the present invention includes a gravity-biased arm which is pivotally mounted on a bowling-ball return apparatus of the type just described. The free end of the arm is swingable from a preselected, at-rest position adjacent the capture station to permit entry of a ball therein. An elongate frictional reach in the arm's free end engages a ball in the capture station, preventing ball spinning—in effect, providing a reaction force to such spinning which propels the ball into the ball-return cradle. After the ball has been captured, the free end of the arm returns by gravity to its preselected position.

These and other objects and features of the present invention will become more fully apparent when read in connection with the following detailed description of a preferred embodiment of the invention and the accompanying drawings.

DRAWINGS

DETAILED DESCRIPTION OF A PREFERRED EMBODIMENT OF THE INVENTION

Figures 1, 2, 3:
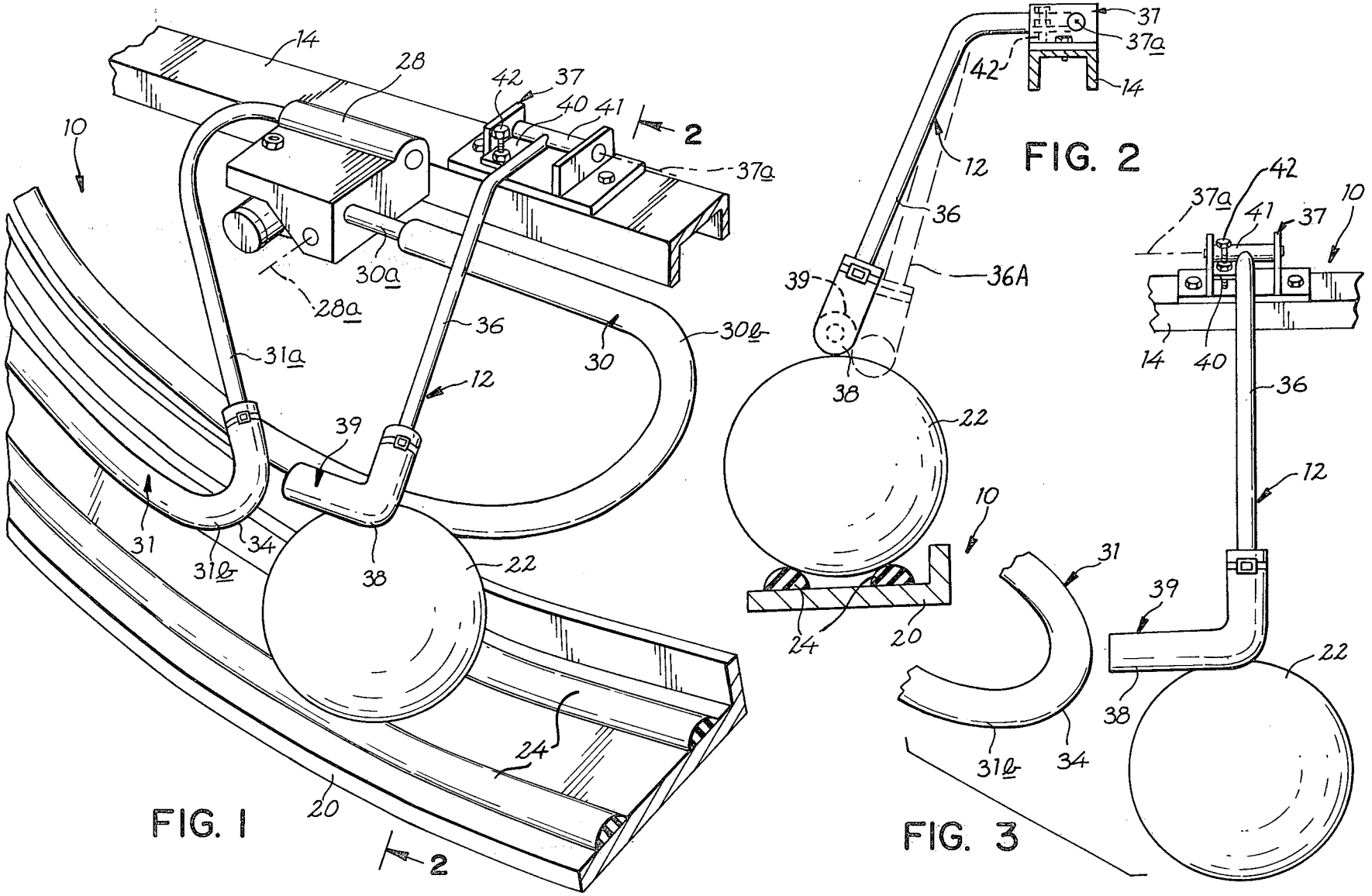
FIG. 1 is a perspective, fragmentary view of ball-return apparatus employing the device of the present invention.
FIG. 2 is a sectional view taken along line 2—2 in FIG. 1.
FIG. 3 shows a portion of FIG. 1 as viewed from the side facing the reader.

Looking first at FIG. 1, there is shown generally at 10 a fragmentary portion of a conventional ball-return apparatus with which the device of the present invention, indicated here at 12, cooperates. Describing only those features of apparatus 10 necessary for an understanding of the present invention, at 14 is shown a portion of a frame. A circular conveyor, shown fragmentarily at 20, is rotatably driven to a clockwise direction in the figure by power-driven rollers (not shown). A pair of annular cushion rings 24 lining the ball-supporting face of the conveyor provide a cushioned, frictional track on which a bowling ball, such as ball 22, rides on the conveyor.

Attached to frame 14, through a pivotally mounted elevator block 28, is a pair of guide members, or lift rods 30, 31. The pivot axis 28*a* for block 28 substantially parallels the rotational axis of conveyor 20. Rods 30, 31 include rigid metal armatures 30*a*, 31*a*, respectively, secured at one set of ends to block 28, with these armatures covered by frictioning coverings 30*b*, 31*b*, respectively. While shown only fragmentarily here, rods 30, 31 extend upwardly toward the top portion of conveyor 20, being generally concentric therewith and spaced radially inwardly therefrom. Bar 31 is bent at 34 to form an elbow positioned to make contact with the upper surface of a bowling ball when the latter travels toward the left in FIG. 1 within the conveyor.

It can be appreciated from the foregoing that in the intended operation of apparatus 10, a ball, such as ball 22, which is deposited on the conveyor at the right of its lowest point thereon in FIG. 1 rolls on the conveyor toward elbow 34. The clockwise rotation of conveyor 20 in this figure acts to rotate the ball against elbow 34, causing rods 30, 31 to pivot upwardly slightly to allow entry of the ball into the cradle formed between the two rods and rings 24. From such capture position, the ball is moved upwardly to a ball-return position.

Looking now at FIGS. 1–3, device 12 generally includes an arm 36 pivotally mounted on a mounting structure 37 which is attached to frame 14 as shown. The pivot axis for arm 36 is shown at 37*a* and is substantially horizontal and parallel to the plane of rotation of conveyor 20. Arm 36 is bent adjacent its upper end (FIG. 2) to position its lower end adjacent the above-mentioned capture station. According to an important feature of the present invention, arm 36 is bent adjacent its lower end to form an elongated reach 39 which extends along and is substantially an elongated segment of the path of a bowling-ball traveling toward the capture station. A reach length of between about seven and eight inches has been found to produce satisfactory ball-capture enhancement in all ball-return apparatus of the type described herein. A friction-surfaced sleeve 38 provides frictioning means mounted on the arm's free end for engaging a ball frictionally upstream from and in the capture station, as will be described below.

Referring particularly to FIG. 2, arm 36 is pivotally mounted on structure 37 through a cylindrical sleeve 41 which is journaled on structure 37 in a conventional manner. Attached to the upper portion of arm 36, adjacent sleeve 41, is a threaded plate 40 which threadedly receives an adjustment bolt 42. The lower end of this bolt bears against a lower plate in mounting structure 37, limiting the gravity-biased position of arm 36 to a predetermined position adjacent the capture station. In dashed outline in FIG. 2, at 36A, arm 36 is shown in such position. Preferably the position of reach 39, with the arm in its just-mentioned predetermined position, is about ½ inch lower than in its ball-engaging position shown in solid outline in the figures.

Looking now at the operation of the present invention, apparatus 10 is generally disposed at a right angle to the associated bowling lane, i.e., the rotational axis of conveyor 20 extends in the direction of the bowling lane. A bowled ball, after passing the pin area, impacts a conventional impact cushion (not shown), and from there, rolls onto the conveyor from a position to the right of the capture station in FIG. 1.

With reference to FIG. 3, as ball 22 enters the conveyor trough, it rolls downwardly toward the capture station, displacing arm 36 upwardly from its at-rest position to the ball-engaging position shown in solid lines. With the weight of arm 36 pressing sleeve 38 against the surface of the ball, the tendency of the ball to back rotate as it moves against elbow 34 is substantially eliminated. Functionally, arm 36 produces a reaction force to clockwise rotation of the ball, wherein the ball is forced, through the rotation of the conveyor wheel into a captured position.

The ball-capture enhancing device described herein provides significant advantages over devices known in the prior art. The elongated reach in the device insures positive ball movement along a substantial path segment which the ball travels in approaching the capture station. Secondly, since the force produced by the device against the ball is due to gravity, rather than to springs, the present device functions reliably and uniformly over extended periods and under different temperature conditions. Also, such force is position independent. The at-rest position of the is easily adjusted (through adjusting belt 42) to provide best ball-capture performance.

While a specific embodiment of the present invention has been disclosed herein, it is recognized that various changes and modifications may be made without departing from the spirit of the invention.

It is claimed and desired to secure by Letters Patent:

1. In a bowling-ball return apparatus having a circular, rotatable conveyor and a frictional guide member cooperative therewith to capture a bowling ball for upward return delivery along a defined path when the ball arrives at a capture station defined by the conveyor and guide member along said path, a device for enhancing such capture comprising an arm pivotally mounted on said apparatus for swinging relative thereto, said arm having a free end movable toward and away from a predetermined position adjacent and upstream from said station, under the influence of gravity, and frictioning means mounted on said free end, including an elongated reach extending generally parallel to an elongated segment of said path which terminates, in a downstream direction, at said capture station, said reach being engageable with a ball as the same travels on the conveyor along such path segment, through movement of said free end away from said predetermined position, against the force of gravity, to bias the ball toward said conveyor, thus to enhance driving engagement between the ball and the conveyor along such path segment.

* * * * *